US005884386A

United States Patent [19]

Blacket et al.

[11] Patent Number: 5,884,386

[45] **Date of Patent: *Mar. 23, 1999**

[54] PANEL CLINCHING METHODS AND APPARATUS

[75] Inventors: Stuart Edmund Blacket, Alderley; Ralph Fuhrmeister, Runcorn, both of Australia

[73] Assignee: Henrob Ltd., Flint, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 554,229

[22] Filed: Nov. 8, 1995

Related U.S. Application Data

[63] Continuation of Ser. No. 244,041, May 20, 1994, abandoned.

[30] Foreign Application Priority Data

Nov. 27, 1991 [AU] Australia ..... PK9742

[51] Int. Cl.[6] ..... B23P 19/00; B23P 11/00

[52] U.S. Cl. ..... 29/522.1; 29/432.2; 29/798

[58] Field of Search ..... 29/243.5, 243.53, 29/243.54, 432, 432.1, 432.2, 507, 508, 509, 521, 522.1, 523, 524.1, DIG. 1, 798; 227/51, 136

[56] References Cited

U.S. PATENT DOCUMENTS

| | | | |
|---|---|---|---|
| 2,160,374 | 5/1939 | Veillette | 29/798 X |
| 2,458,152 | 1/1949 | Eakins | 18/59 |
| 2,753,624 | 7/1956 | Taylor | 29/525.2 X |
| 3,022,687 | 2/1962 | Richards | 78/16 |
| 3,198,155 | 8/1965 | Fraze | 113/121 |
| 3,829,957 | 8/1974 | Pouch et al. | 29/445 |
| 3,851,373 | 12/1974 | Shinjo | 29/798 X |
| 3,871,264 | 3/1975 | Hallock | 85/30 |
| 3,875,599 | 4/1975 | Mracek et al. | 5/348 R |
| 3,919,955 | 11/1975 | DuVernay | 113/1 N |
| 3,958,389 | 5/1976 | Whiteside et al. | 52/758 D |
| 4,249,298 | 2/1981 | Kanamaru et al. | 29/520 |
| 4,359,813 | 11/1982 | Mauer | 29/469.5 |
| 4,484,385 | 11/1984 | Woods | 29/798 X |
| 4,615,475 | 10/1986 | Fuhrmeister | 227/136 |
| 4,803,767 | 2/1989 | Obrecht et al. | 29/243.5 |
| 5,000,222 | 3/1991 | Moenkhaus et al. | 137/505.41 |
| 5,051,020 | 9/1991 | Schleicher | 403/282 |
| 5,121,537 | 6/1992 | Matsui et al. | 29/522.1 |
| 5,208,974 | 5/1993 | Sawdon et al. | 29/798 |

FOREIGN PATENT DOCUMENTS

| | | |
|---|---|---|
| 11072/61 | 5/1963 | Australia . |
| 7608/61 | 5/1963 | Australia . |
| 32537/71 | 2/1973 | Australia . |
| 70379/74 | 1/1976 | Australia . |
| 76786/91 | 10/1991 | Australia . |
| 215449 | 3/1987 | European Pat. Off. . |
| 330061 | 8/1989 | European Pat. Off. . |
| 351715 | 1/1990 | European Pat. Off. . |
| 1452820 | of 0000 | Germany . |
| 3726392 | 1/1991 | Germany . |
| 4009813 | 1/1991 | Germany . |
| 912516 | 12/1962 | United Kingdom . |
| 2123734 | 2/1984 | United Kingdom . |
| 2244946 | 12/1991 | United Kingdom . |

OTHER PUBLICATIONS

Patent Abstracts of Japan, M–823, p. 131, JP, A, 1–22427, (Toyo Seikan Kaisha Ltd), 25 Jan. 1989.

*Primary Examiner*—Peter Vo
*Attorney, Agent, or Firm*—Foley & Lardner

[57] ABSTRACT

Apparatus and method for forming a clinched joint between at least two panels with a rivet or slug by driving the rivet or slug into the at least two panels thereby outwardly deforming at least the inner end of the slug or rivet. Rings or components forming parts of the joint can be secured to the panels wherein the rings or components are acting as the dies for forming the joint.

26 Claims, 11 Drawing Sheets

PANEL CLINCHING METHODS AND APPARATUS

This application is a continuation of application Ser. No. 08/244,041, filed May 20, 1994 now abandoned, which is the national stage of PCT/AU92/00631, filed Nov. 11, 1992.

BACKGROUND OF THE INVENTION

1. Field of the Invention

This invention relates to improved panel clinching methods. The term "clinching" is also known as "press joining" or "integral fastening".

2. Prior Art

Spot welding is the most commonly used technique for joining vehicle body components in the automotive industries. As the strength of each spot weld cannot be guaranteed, eg. due to the inclusion of rubbish between the components, or poor weld penetration, designers must increase the number of welds to ensure adequate joint strength.

Spot welding has not yet been developed as an accurate, reliable method for joining galvanized steel or aluminum components.

With galvanized steel, welding action destroys the galvanized about the weld site, making it liable to corrosion.

Aluminum has great potential in the automobile field due to its light weight, but the lack of a suitable spot welding method is one reason which has minimized its application.

One alternative to spot welding is the use of self-piercing rivets, and a method of, and apparatus for, the fastening of metal panels with self-piercing rivets is disclosed in U.S. Pat. No. 4,615,475 (Fuhrmeister) (International Publication Number WO 84/04710).

A further alternative method is metal clinching, where two sheets of metal are deformed into a locking engagement using a punch-and-die combination. Examples of metal clinching methods are disclosed in:

1. DE 4009813 (Fraunhoffer-Ges Ford Ange);
2. DE 1452820 (Philips Patentverwaltung GmbH);
3. DE 3726392 (Kuka Schweissanlage);
4. EP 330061 (Eckold W. & Co GmbH);
5. EP 215449 (Rapp E.);
6. GB 2244946 (Fairacre Limited);
7. GB 2123734 (BTM Corporation);
8. U.S. Pat. No. 3,919,955 (Du Vernay); and
9. U.S. Pat. No. 387,599 (Ladouceur et al).

While these methods enable metal sheets to be joined together, they have relatively low shear and axial load strengths, and the joints do not have an outer face substantially flush with the surrounding sheet metal (and are therefore not applicable in exposed areas, eg. within an engine compartment).

SUMMARY OF THE PRESENT INVENTION

It is an object of the present invention to provide a panel clinching method where the shear strengths of the clinching joint are increased.

It is a preferred object to provide a method where the axial load strength of the clinched joint is increased.

It is a further preferred object to provide a method where the outer face of the joint may be substantially flush with the surrounding sheet metal.

It is a still further preferred object to provide a method where ancillary components may be supported by or from the clinched joint.

It is a still further preferred object to provide a method where the clinched joint may be "capped" to constrain any stress lines in the metal panels in the region of the joint.

Other preferred objects will become apparent from the following description.

In one aspect, the present invention resides in a panel clinching method wherein:

a hollow rivet or full tubular slug is driven or inserted into a clinched joint and at least the inner end of the shank of the rivet or slug is outwardly-deformed within the joint.

The term "outwardly-deformed" shall be used to include deformation of all or part of the shank or stem of the rivet or slug in at least one direction lateral (or transverse) to the longitudinal axis of the shank or stem.

In a single stage method, the rivet or slug may be inserted into the joint as the joint is formed, the rivet or slug cooperating with the punch to deform the panels into the supporting die. In a two-stage process, the rivet or slug cooperating with the metal panels into the die, and a sleeve external to the punch then deforms the rivet or slug within the joint.

The bore of the rivet or slug may be threaded, serrated or otherwise profiled to engage and support an anchor, e.g., a wiring loom support, a trim cover panel fastener or the like. A plastic insert may be fitted to the rivet or slug to provide a flush outer face.

Preferably, the panels are pre-clamped to the die before the punch drives the rivet or slug into the panels to form the clinched joint; or before the clinched joint is formed and the rivet or slug inserted into the joint.

In a second aspect, the present invention resides in a panel clinching method where a solid or semi-tubular rivet or slug is driven or inserted into a clinched joint and at least the inner end of the shank of the rivet or slug is outwardly-deformed within the joint.

In a single stage process, the rivet or slug is interposed between the punch and the outer panel (to be joined) and the rivet or slug is used to deform the metal panels into the die as the clinched joint is formed.

In a two-staged process, a conventional button-type clinched joint is formed and then the rivet or slug is pressed into the joint by the punch.

Preferably, the panels are pre-clamped to the die before the clinched joint is formed.

In a third aspect, the present invention resides in a panel clinching method where a ring, or a body or component having a tapered bore or recess, is supported by a die and at least one panel is deformed into the ring or the bore or recess to form a clinched joint therewith.

Preferably, the panels are deformed behind the ring or into engagement with inwardly-divergent walls in the recess.

In a fourth aspect, the method of the third aspect is used in combination with the hollow rivet or tubular slug of the first aspect, or the solid or semi-tubular rivet or slug of the second aspect.

In a fifth aspect, the present invention resides in a clinched joint for panels formed by the method of any one of the first to fourth aspects.

While the invention is particularly suitable for joining sheet metal panels, it is also suitable for polymeric materials (eg. polyethylene, polyurethane, polypropylene, nylon) where one or more metal panels are substituted by panels of polymeric material. For example, the methods are suitable for joining, e.g. an aluminium sheet to a polypropylene sheet, where the polymeric sheet may be locally preheated e.g. by the supporting die) to assist in the "flow" of the polymeric material as the joint is formed. The rings or components may also be formed of polymeric material and be clinched to metal and/or polymeric material sheets.

The shanks of the rivets or slugs may be provided with external splines, grooves, teeth or other protrusions or recesses to provide additional grip between the rivets or slugs and the panels in the clinched joint.

Adhesives can be applied, eg. to the shanks of the rivets or slugs to assist bonding of the rivets or slugs to the panels. Adhesives may also be provided within the bore of the tubular or semi-tubular rivets or slugs to be extruded into the clinched joint, as the rivets or slugs are deformed, to assist the bonding of the rivets or slugs to the panels.

DETAILED DESCRIPTION OF THE PREFERRED EMBODIMENTS

Figure 3:
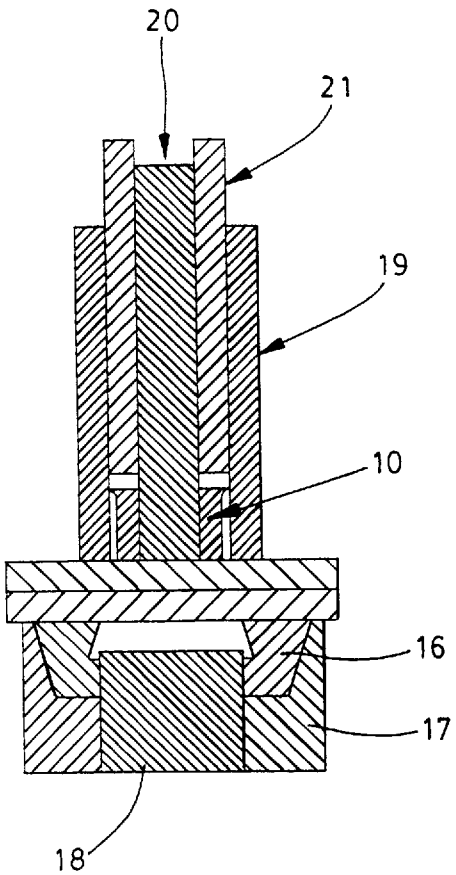
FIGS. 2 to 5 are sectional side views of the steps in a two-stage process of forming a clinched joint of a first embodiment.
Figure 2:
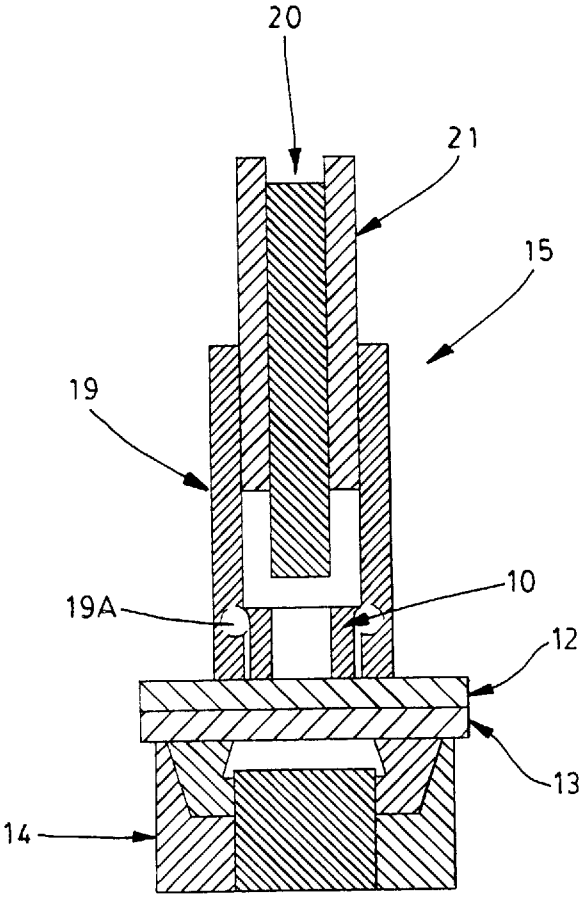
Figure 1:
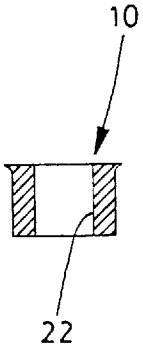
FIG. 1 is a sectional side view of a hollow rivet or tubular slug suitable for clinching two panels of metal together.
Figure 6:
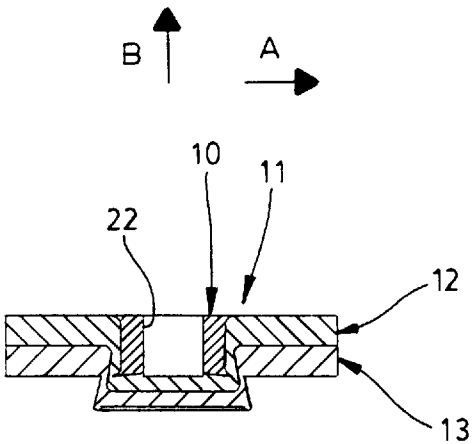
FIG. 6 is a sectional side view of the clinched joint of the first embodiment.
Figure 5:
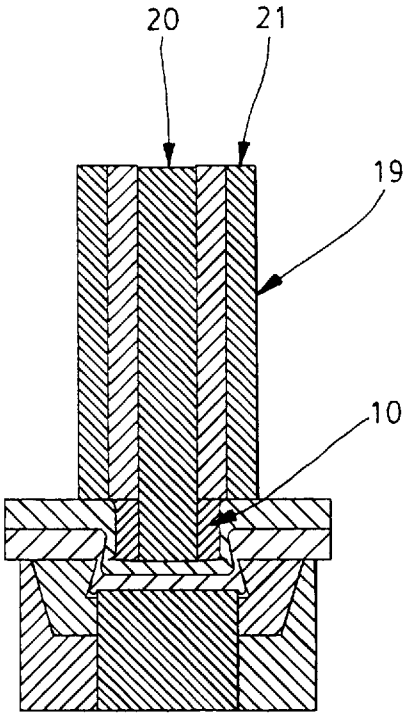
Figure 4:
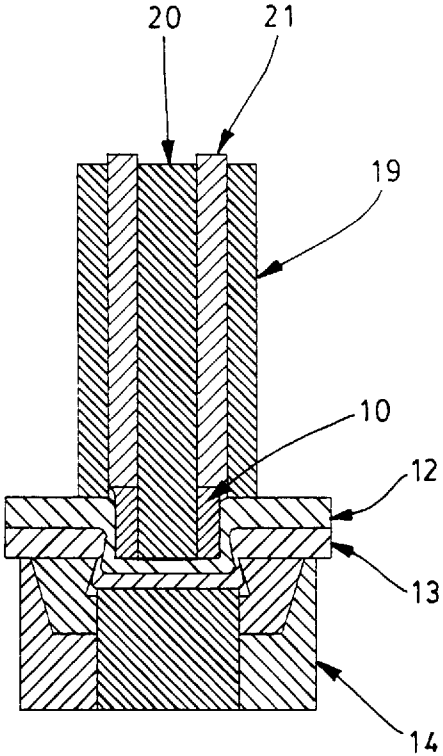
Figure 9:
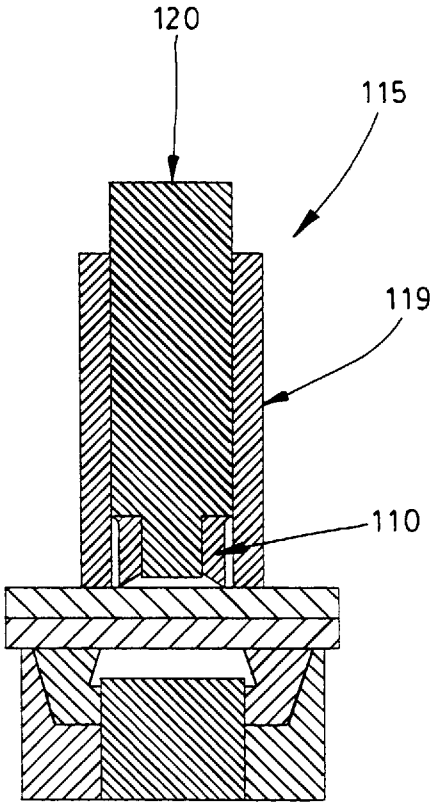
FIGS. 8 to 11 are sectional side views of the steps in a single-stage process of forming a clinched joint of a second embodiment.
Figure 8:
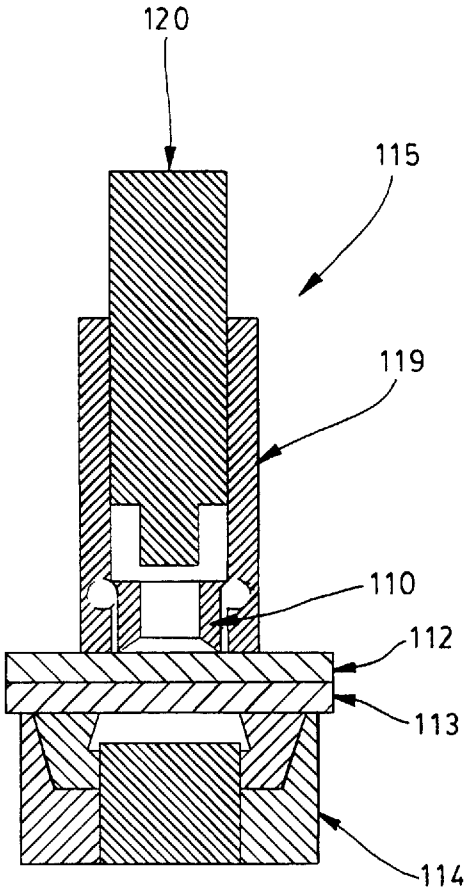
Figure 7:
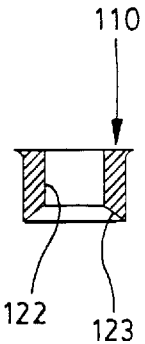
FIG. 7 is a sectional side view of a modified tubular rivet or slug.
Figures 10, 11, 12:
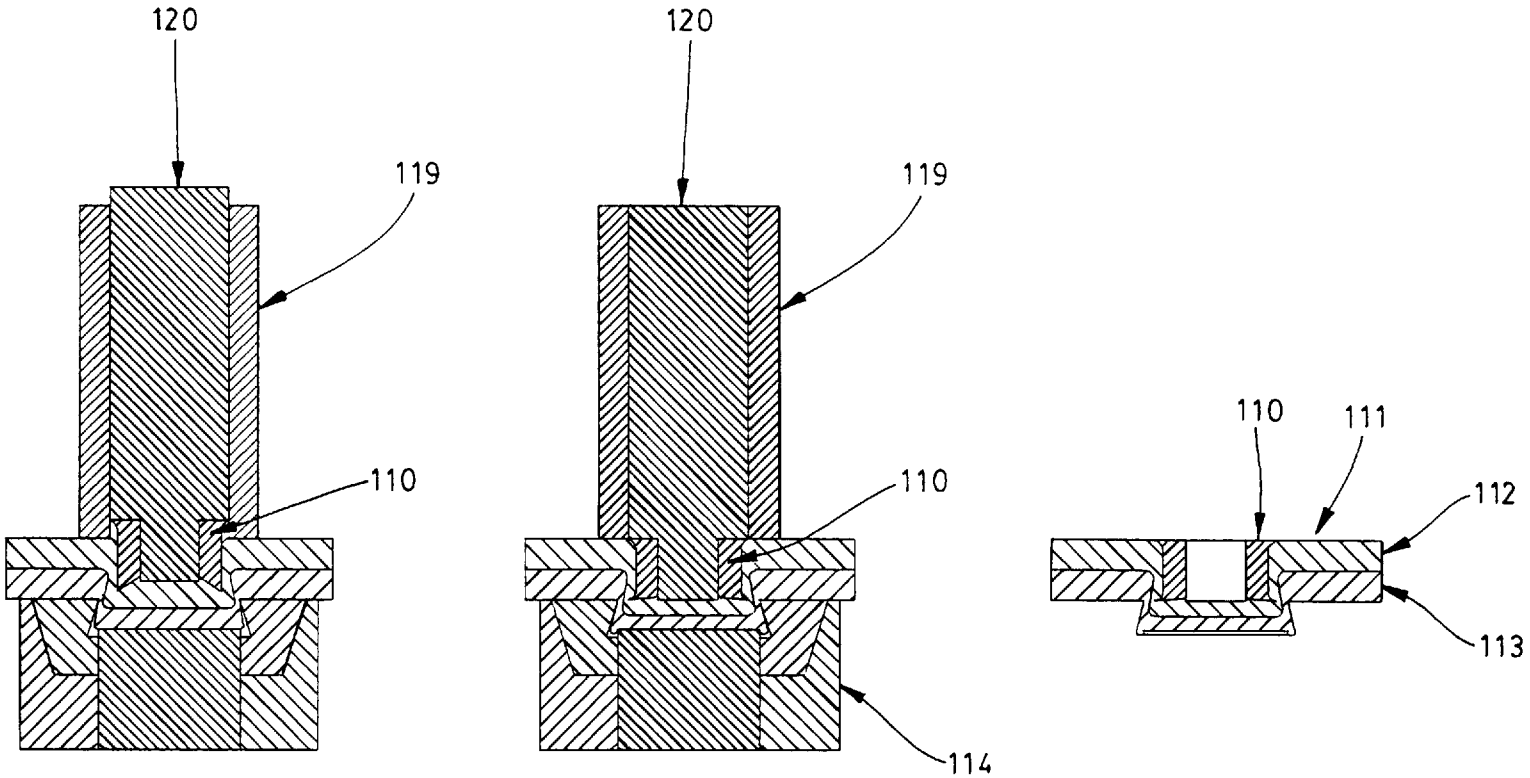
FIG. 12 is a sectional side view of the clinched joint of the second embodiment.

Referring now to FIGS. 1 to 6, the tubular rivet 10 of FIG. 1 is driven into the metal panels to form the clinched joint 11 of FIG. 6.

The metal panels 12, 13 to be joined together are supported on the die assembly 14 of a clinching or tools, the die assembly having expandable and contractable collets 16 associated with a collet holder 17 and anvil 18 arranged to allow the joint 11 to be released when formed.

The clinching tool 15 has a pre-clamping head 19 which clamps the metal panels 12, 13 to the die assembly and has internal (spring-loaded) balls 19A to locate and centralise the rivet 10. A punch 20 is slidably journalled in a sleeve 21 slidably journalled in the pre-clamping head 19, and the punch 20 and sleeve 21 are connected to respective hydraulic rams (not shown).

The operation of the clinching tool 15 will now be described.

After the metal panels 12, 13 are clamped to the die assembly 14 by the pre-clamping head 19, the punch 20 is driven through the rivet 10 into engagement with the upper panel 12, with the sleeve 21 engaging the rivet 10. The punch 20 and rivet 10 are advanced to deform the metal panels 12, 13 into the die assembly 14 (see FIG. 4). The sleeve 21 is then advanced to cause the inner end of the rivet 10 to be outwardly-deformed (see FIGS. 5 and 6).

The anvil 18 can be spring-loaded or forcibly raised as a post-forming operation against the punch 20 to assist in deforming the rivet or slug.

The insertion and deformation of the rivet assists in locking the metal panels 12, 13 together, with increase in the shear and axial separation strengths (i.e.) in the direction of arrows A and B, respectively).

The bore 22 of the rivet 10 may be threaded to receive a fastener or plug to support, e.g. an electrical wiring loom or a plastic insert to form a flush cover for the clinched joint 11.

Referring now to FIGS. 7 to 12, a modified tubular rivet 110 has a tapered end 123 to its inner bore 22.

In this one-stage method, the sleeve 21 is eliminated and the punch 120 is slidably journalled in the pre-clamping head 119. The metal sheets 112, 113 are supported by the die assembly 114 and clamped thereto by the clamping head 119. The punch 120 engages the rivet 110 (see FIG. 9) and drives the rivet 110 into the metal panels 112, 113 which are deformed into the die assembly 114 (see FIG. 10). The punch 120 is further advanced (see FIG. 11) to deform the inner end of the rivet 110 to form the clinched joint 111 (see FIG. 12).

To increase the strength of the clinched joints 11, 111, a solid or semi-tubular rivet or slug may be used.

Figure 16:
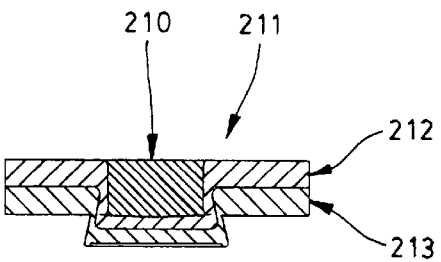
FIG. 16 is a sectional side view of the clinched joint of the third embodiment.
Figure 15:
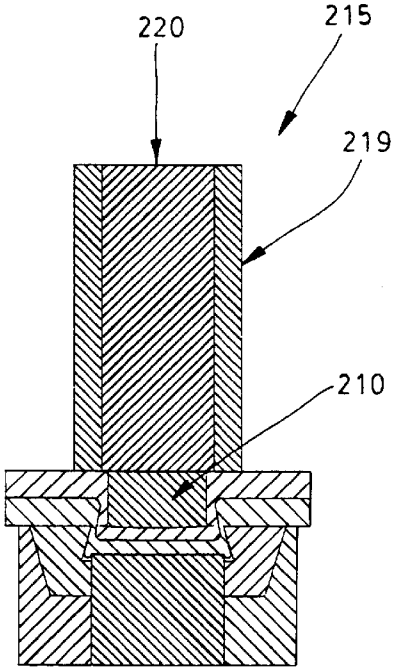
FIGS. 14 and 15 are sectional side views of the steps of forming a clinched joint of a third embodiment.

Referring now to FIGS. 13 to 16, a solid slug 210 (FIG. 13) has a concave recess 222 at its lower end and is used to form the clinched joint 211 of FIG. 16.

Figure 14:
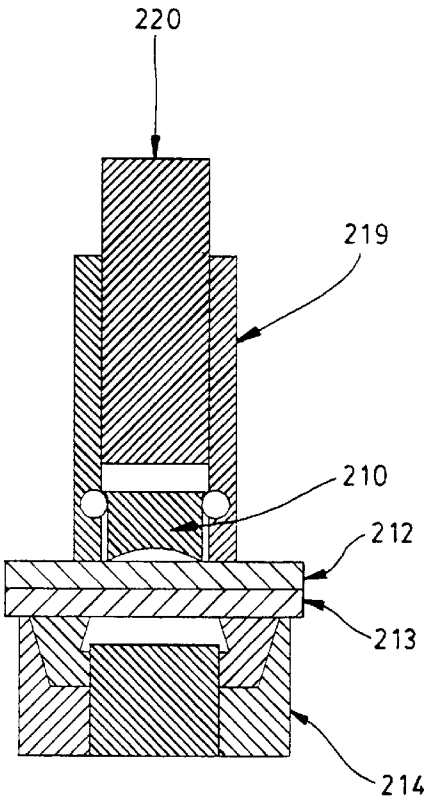
Figure 13:
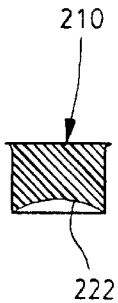
FIG. 13 is a sectional side view of a solid rivet or slug.
Figure 19:
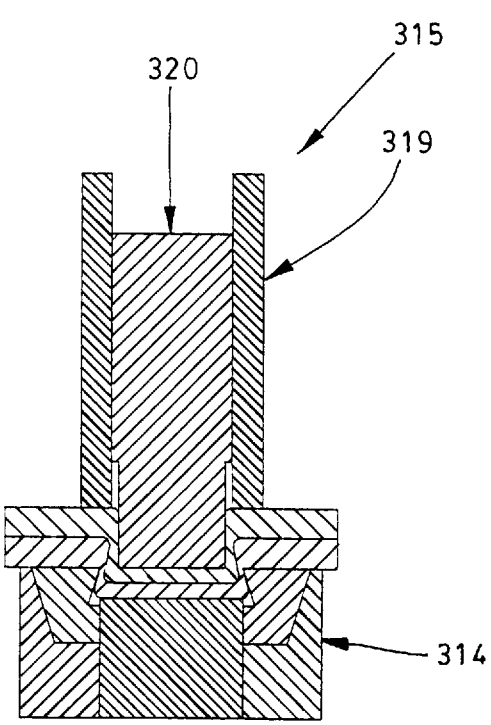
FIGS. 18 to 22 are sectional side views of the steps of forming a clinched joint of the fourth embodiment.
Figure 18:
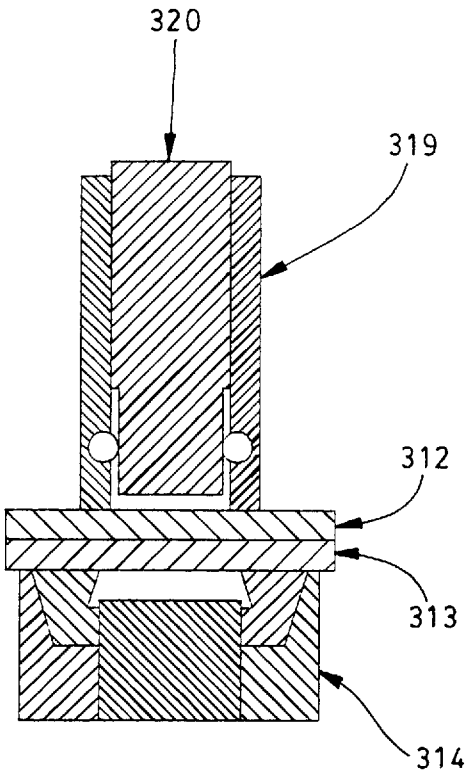

The metal sheets 212, 213 are clamped to the die assembly 214 by the clamping head 219 (see FIG. 14). The punch 220 is advanced to drive the slug 210 (as an extension of the punch 220) into the metal panels 212, 213 to deform the panels into the die assembly 214 to form the clinched joint 211. It will be noted that the head of the slug 210 is flush with the outer face of panel 212 and such a joint is suitable where aesthetic appeal is required, e.g. on a visible surface of a vehicle body.

Figure 17:
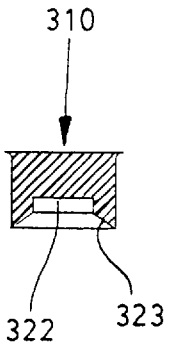
FIG. 17 is a sectional side view of a semi-tubular rivet or slug.

The semi-tubular slug 310 (see FIG. 17) has a tapered end 323 to its bore 322.

Figure 20:
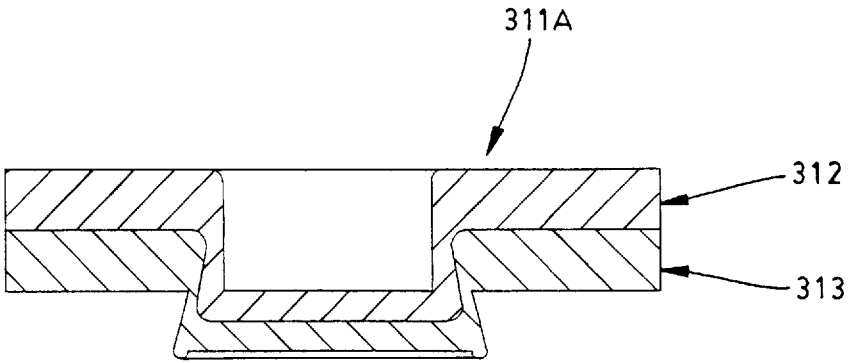

In the two-stage process shown in FIGS. 18 to 23, the metal panels 312, 313 are pre-clamped to the die assembly 314 by the clamping head 319 and the punch 320 is advanced (see FIG. 19) to form a conventional button-type clinched joint 311A (see FIG. 20). The punch 320 is retracted and a semi-tubular slug 310 is placed in the clinching tool.

Figures 21, 22, 23:
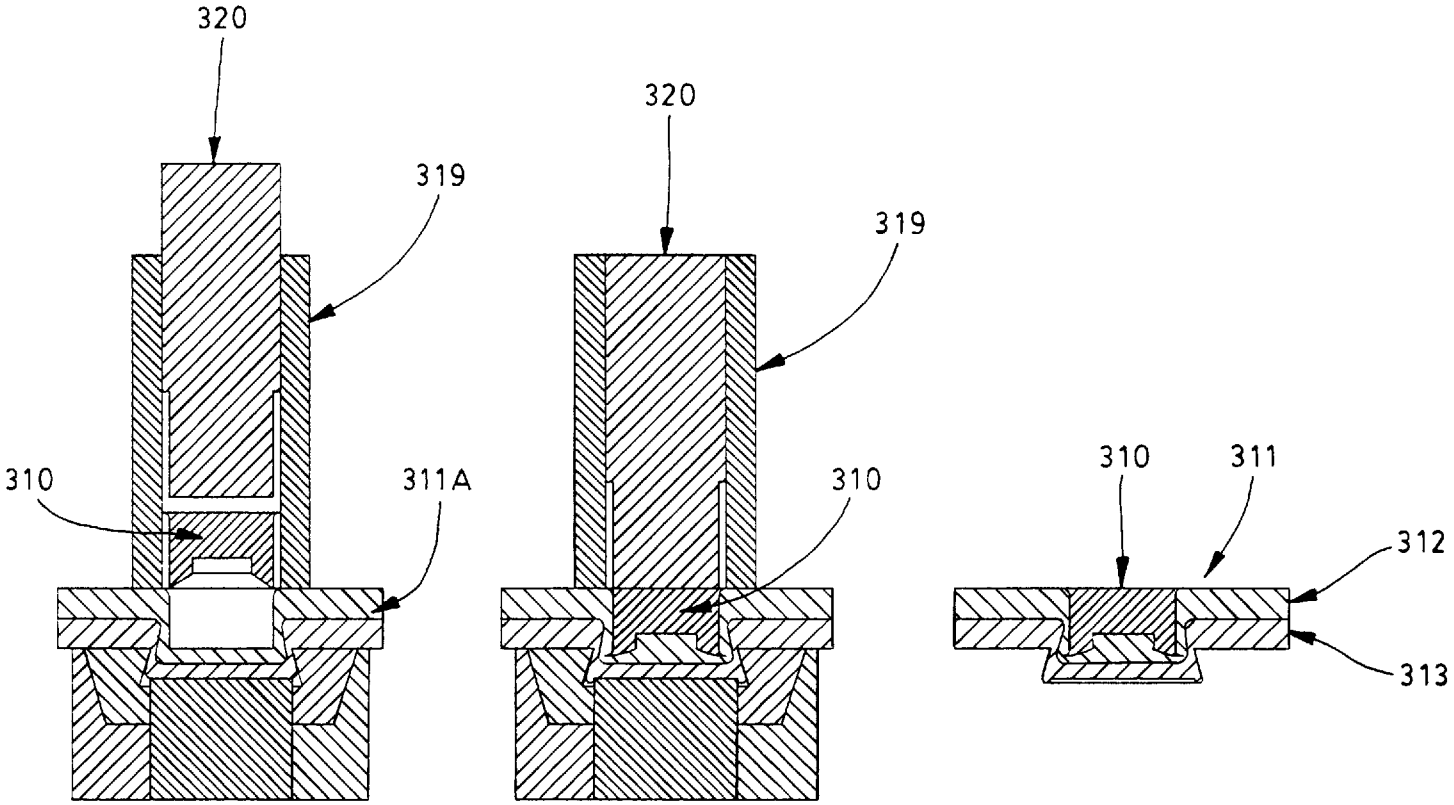
FIG. 23 is a sectional side view of the clinched joint of the fourth embodiment.

The pre-clamping head 319 clamps the panels (see FIG. 21) and the punch 320 is advanced to drive the slug 310 into the clinched joint 311A to deform the slug 310 to form the clinched joint 311 (see FIG. 23).

Figure 25:
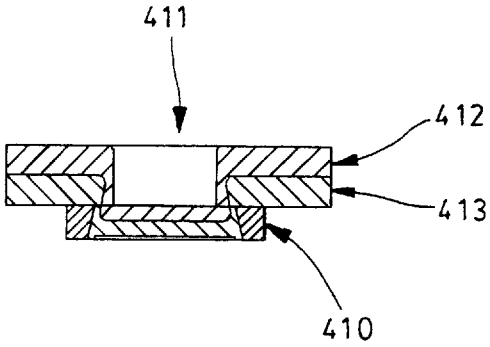
FIG. 25 is a sectional view of the clinched joint of the fifth embodiment.
Figure 24A:
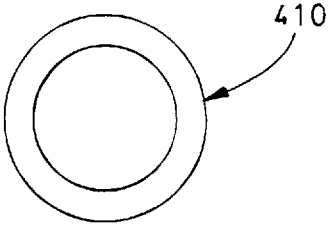
FIGS. 24*a*, 24*b*, and 24*c* are top plan, sectional and bottom plan views, respectively, of a ring.
Figure 24B:
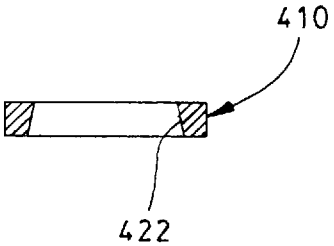
Figure 24C:
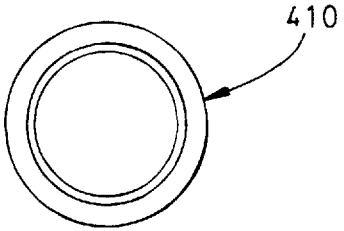

Referring now to FIGS. 24 and 25, the rivets or slugs (10, 110, 210, 310) may be substituted by a (metal or plastic) ring 410 which engages the lower panel 413 to lock the clinched joint 411, the panels 412, 413 being deformed into the divergently tapered bore 422 of the ring 410. The ring 410 is supported by a die assembly (not shown) as the punch (not shown) deforms the panels 412, 413, the ring 410 acting as the die body.

Figure 26:
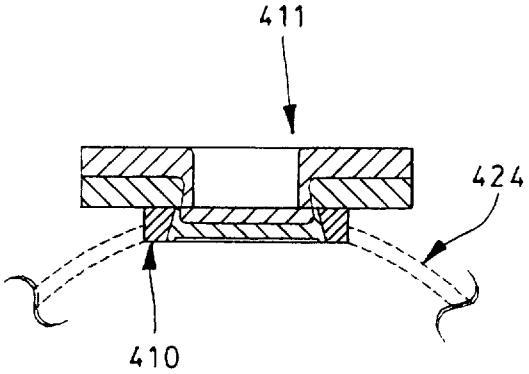
FIG. 26 is a similar view of a modified form of the clinched joint of FIG. 25.

As shown in FIG. 26, straps or clips 424 may be formed integrally with the ring 410, e.g. to secure wiring to a vehicle body. If requested, the ring 410 can be combined with the method of FIGS. 17 to 23, where a solid or semi-tubular slug is pressed into the clinched joint 411 to form a flush surface with panel 412.

Figure 28:
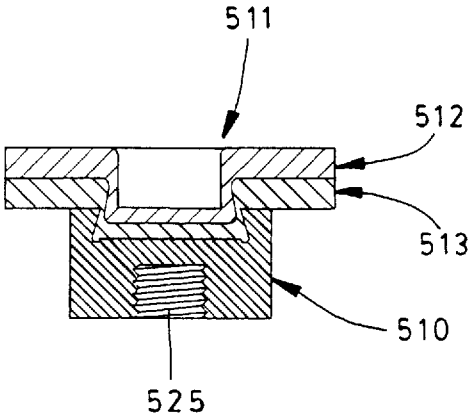
FIG. 28 is a sectional side view of a clinched joint of a sixth embodiment.
Figure 27A:
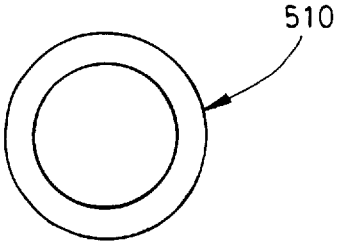
FIGS. 27*a*, 27*b*, and 27*c* are top plan, sectional and bottom plan views, respectively, of a component.
Figure 27B:
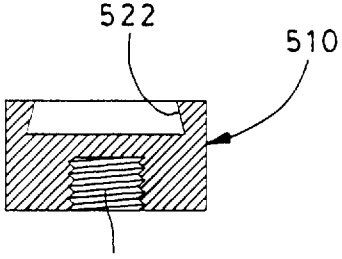
Figure 27C:
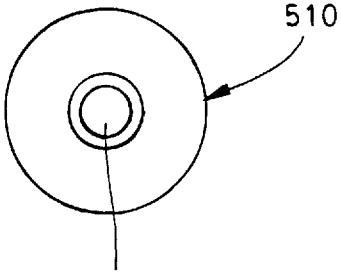

A component 510 (see FIGS. 27 to 29), with a tapered recess or bore 522, and a screw-threaded hole 525 (as part of a sub-assembly—not shown) can also be employed as the die for the clinched joint 511 and provide a mount for the sub-assembly secured to the panels 512, 513.

Figure 29:
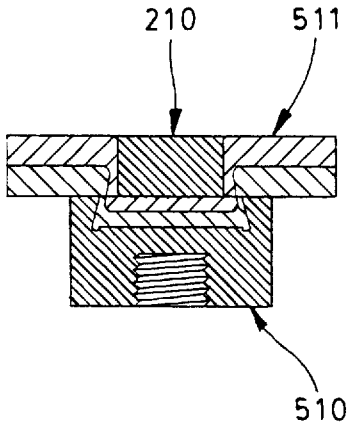
FIG. 29 is a similar view of a modified form of the clinched joint of FIG. 28.

As shown in FIG. 29, a solid slug 210 can be pressed into the clinched joint 511. (The slug 210 may be screw-threaded and have a slot, Philips-head slot or an Allen-head recess to enable the slug 210 to be removed later if required for disassembly of the joint 511.)

Figure 32:
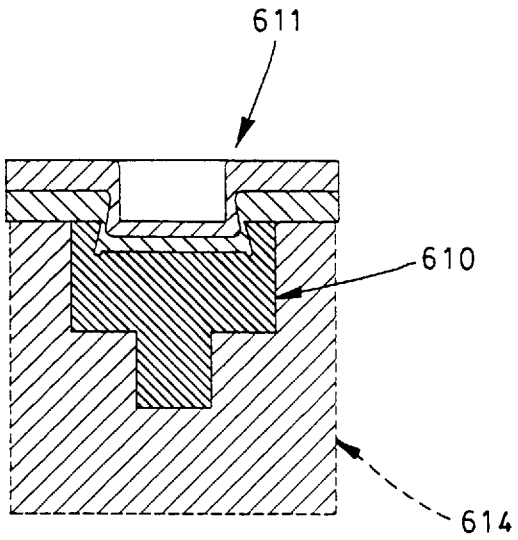
FIG. 32 is a sectional side view showing the clinched joint of FIG. 31 where the component is supported in a die.
Figure 31:
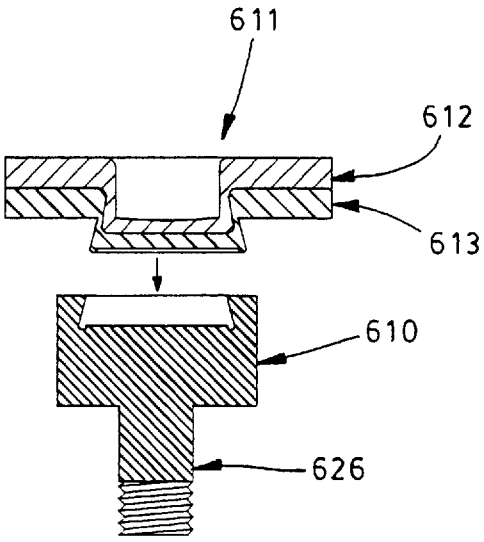
FIG. 31 is a sectional side view of a clinched joint of a seventh embodiment.
Figure 30A:
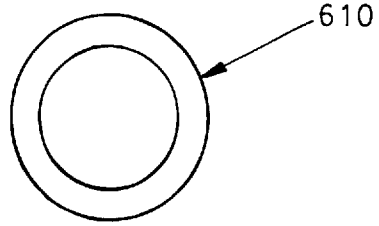
FIGS. 30*a*, 30*b*, and 30*c* are top plan, sectional and bottom plan views, respectively, of a second component.
Figure 30B:
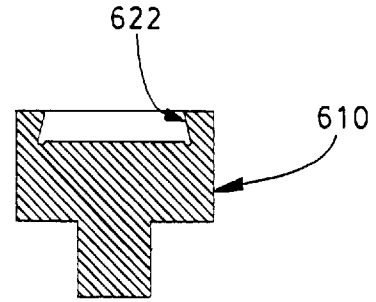
Figure 30C:
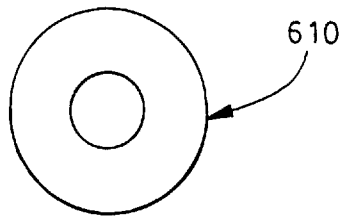

FIGS. 30 to 32 show the attachment of a second component 610, with a bore 622 and a plain spigot (FIG. 30) or screw-threaded end spigot 626 (FIG. 31), secured to the clinch-joint 611. (The spigot may also be profiled, e.g. engageable in a catch or lock means.)

FIG. 32 shows the component 610 supported by a die assembly 614 during the clinching step.

In the methods shown in FIGS. 24 to 26; 27 to 29; and 30 to 32, two panels 412, 413; 512, 513; 612, 613 are shown secured in the ring 410, and components 510, 610. The methods are also applicable to securing a single panel to the ring 410 on components 510, 610.

In addition, in all of the methods, one or bath panels may be a polymeric sheet (e.g. polypropylene). It is preferred that the inner sheet (e.g. 13, 113) being the polymeric sheet and the die assembly may be heated at the location of the clinched joint to assist "flow" of the polymeric material.

For improved recycling, it is preferred that the rivets 10, 110; slugs 210, 310; ring 410; or components 510, 610 be of the same type of material as the panels as this will obviate the need for disassembly of the joints.

As an indication of the advantage of methods of the present invention, the use of an 8 mm solid rivet or slug in conjunction with a clinched joint increase the shear strength of a sheet metal joint by 50%, and the strength in both the shear and axial separation directions can be maintained within controlled limits, unlike spot welds. This means the number of clinched joints can be much less than the number of spot welds, and the joints-can also support sub-assemblies.

Various changes and modifications may be made to the embodiments described and illustrated without departing from the scope of the present invention defined in the appended claims.

We claim:

1. A panel clinching method for clinching together at least two panels, utilizing a rivet including a shank having an inner end, a punch, and a sleeve external of the punch, the method comprising the steps of:

supporting the panels on a supporting die formed with an opening to receive the panels when they are deformed;

positioning the rivet over the panels in the area to be clinched, with the sleeve surrounding the punch;

advancing the punch and the sleeve downwardly to deform the panels into the die opening and form the clinched joint; and thereafter advancing the sleeve independently of the punch to cause the inner end of the shank of the rivet to be outwardly deformed, consequently deforming the panels, the deformation of the inner end of the shank of the rivet being caused solely by the independent advancement of the sleeve.

2. The panel clinching method as claimed in claim 1, wherein the panels to be joined are pre-clamped to the die before the punch drives the rivet into the panels to form the clinched joint.

3. The panel clinching method as claimed in claim 1, wherein at least one panel is a metal sheet and at least one panel is a polymeric sheet, the polymeric sheet being pre-heated in the zone of the clinched joint to encourage the flow of the polymeric material as the panels are deformed.

4. The panel clinching method as claimed in claim 1, wherein an adhesive is applied to the rivet to assist bonding between the panels and the rivet.

5. The panel clinching method as claimed in claim 1, wherein the rivet is tubular and an adhesive is applied to the bore of the tubular rivet, the adhesive being extruded into the clinched joint when the tubular rivet is deformed to assist bonding between the panels and the rivet.

6. The panel clinching method as claimed in claim 1, wherein the rivet has a shank with at least one external protrusion to provide additional grip between the rivet and the panels in the clinched joint.

7. The panel clinching method as claimed in claim 1, wherein deformation of the rivet and the panels is effected without the rivet penetrating through the panels.

8. A panel clinching method for clinching together at least two panels, utilizing a slug including a shank having an inner end, a punch, and a pre-clamping head external of the punch, the method comprising the steps of:

supporting the panels on a supporting die formed with an opening to receive the deformed panels, and clamping the panels with the pre-clamping head;

advancing the punch downwardly to deform the panels into the die opening to form a clinched joint;

thereafter raising the punch, thereby creating a cavity above the clinched joint and below the punch;

positioning the slug in the cavity; and again advancing the punch to move the slug into the clinched joint, and continuing to advance the punch to deform the inner end of the shank of the slug and consequently the panels, thereby forming a joint that includes the slug driven into the clinched joint.

9. The panel clinching method as claimed in claim 8, wherein the panels to be joined are pre-clamped to the die before the punch is advanced to deform the panels and drive the rivet into the panels to form a clinched joint.

10. The panel clinching method as claimed in claim 8, wherein at least one panel is a metal sheet and at least one panel is a polymeric sheet, the polymeric sheet being pre-heated in the zone of the clinched joint to encourage the flow of the polymeric material as the panels are deformed.

11. The panel clinching method as claimed in claim 8, wherein an adhesive is applied to the rivet to assist bonding between the panels and the rivet.

12. The panel clinching method as claimed in claim 8 wherein deformation of the slug and the panels occurs without the slug penetrating the panels.

13. Apparatus for clinching together at least two panels by a tubular rivet having a bore and a shank with an inner end, comprising:

a die for supporting the panels, the die having a die opening;

a punch for alignment with the bore of the rivet and being movable through the bore of the rivet;

a sleeve for axial alignment with the rivet and being external of the punch and advanceable independently of the punch; and a pre-clamping head positioned outwardly of the sleeve for engaging and clamping the panels to the die, wherein the punch and the sleeve, when advanced, engage and deform the panels into the die opening to form the clinched joint, subsequent advancement of the sleeve independent of the punch serving to outwardly deform the inner end of the shank of the rivet, and consequently deforming the panels to secure the clinched joint, the deformation of the inner end of the shank of the rivet being caused solely by the independent advancement of the sleeve.

14. The apparatus as claimed in claim 13 wherein the rivet does not penetrate the panels.

15. Apparatus for clinching together at least two panels by a slug having a shank with an inner end, comprising:

a die for supporting the panels, the die having a die opening;

a punch for alignment with the die opening and having a punching face similar in diameter to the slug; and a pre-clamping head for engaging and clamping the panels to the die and being positioned external of the punch, wherein the punch, when advanced, engages and deforms the panels into the die opening to form the clinched joint having a cavity into which the slug is positioned when the punch is withdrawn, subsequent advancement of the punch when the slug is in position in the cavity serving to secure the slug in the clinched joint by deforming the inner end of the shank of the slug and contiguous portions of the panels, thereby forming a joint that includes the slug driven into the clinched joint.

16. The apparatus as claimed in claim 15, wherein the slug does not penetrate the panels.

17. A panel clinching method for clinching together at least two panels, utilizing a punch, a die, and a ring having an outwardly and downwardly tapered bore, the method comprising the steps of:

supporting the ring on the die;

positioning the panels over the ring, and advancing the punch toward the die to cause materials of the panels to flow into the ring and be expanded into engagement with the tapered bore of the ring, the tapered bore of the ring preventing separation of the clinched joint.

18. The panel clinching method as claimed in claim 17, wherein at least one panel is a metal sheet and at least one panel is a polymeric sheet, the polymeric sheet being preheated in the zone of the clinched joint to encourage the flow of the polymeric material as the panels are deformed.

19. The panel clinching method as claimed in claim 17, wherein the ring is formed of metal or polymeric material.

20. The panel clinching method as claimed in claim 17, wherein an adhesive is applied to the ring to assist bonding between the panels and the ring.

21. The panel clinching method as claimed in claim 20, wherein at least one panel is a metal sheet and at least one panel is a polymeric sheet, the polymeric sheet being preheated in the zone of the clinched joint to encourage the flow of the polymeric material as the panels are deformed.

22. A panel clinching method for clinching together at least two panels, utilizing a punch and a die, the method comprising the steps of:

providing a hollow component having a through bore, the bore having an inner recess defined by an inner surface thereof, said inner surface tapering downwardly and outwardly from a top towards a bottom of the component;

supporting the bottom of the component on the die;

positioning the panels over the top of the component; and advancing the punch toward the die to cause material of the panels to flow into the inner recess in the component and be expanded into engagement with the tapered inner surface of the component to form a clinched joint, the tapered inner surface of the component preventing separation of the clinched joint.

23. The panel clinching method as claimed in claim 22, wherein the component is formed of metal or polymeric material.

24. The panel clinching method as claimed in claim 22, wherein an adhesive is applied to the component to assist bonding between the panels and the component.

25. A panel clinching method for clinching together at least two panels, utilizing a rivet having a bore and including a shank having an inner end, the method comprising the steps of:

providing a punch having a main body with an engaging shoulder and a reduced diameter lower end for fitting within the bore of the rivet, the lower end of the punch having a height less than a height of the rivet;

supporting the panels on a supporting die formed with an opening to receive the panels when they are deformed;

positioning the rivet over the panels in the area to be clinched;

advancing the punch until the shoulder of the main body engages the top of the rivet at which position the lower end of the punch is spaced slightly above the panels;

further advancing the punch downwardly to deform the panels into the die opening and form the clinched joint, and thereafter again advancing the punch downwardly, deforming the inner end of the shank of the rivet and consequently the contiguous portions of the panels to secure the clinched joint.

26. The panel clinching method as claimed in claim 25 wherein deformation of the rivet and the panels occurs without the rivet penetrating through the panels.

* * * * *